US006182362B1

(12) United States Patent
Lancefield

(10) Patent No.: US 6,182,362 B1
(45) Date of Patent: Feb. 6, 2001

(54) METHOD OF MANUFACTURING A MULTI-COMPONENT CAMSHAFT

(75) Inventor: Timothy Mark Lancefield, Bicester (GB)

(73) Assignee: Mechadyne PLC, Kidlington (GB)

( * ) Notice: Under 35 U.S.C. 154(b), the term of this patent shall be extended for 0 days.

(21) Appl. No.: 09/403,807

(22) PCT Filed: Mar. 19, 1998

(86) PCT No.: PCT/GB98/00839

§ 371 Date: Oct. 25, 1999

§ 102(e) Date: Oct. 25, 1999

(87) PCT Pub. No.: WO98/49429

PCT Pub. Date: Nov. 5, 1998

(30) Foreign Application Priority Data

Apr. 26, 1997 (GB) ..... 9708445

(51) Int. Cl.[7] ..... B21D 53/84
(52) U.S. Cl. ..... 29/888.1; 29/557
(58) Field of Search ..... 29/888.1, 557, 29/428; 74/567, 569

(56) References Cited

U.S. PATENT DOCUMENTS

| | | | | |
|---|---|---|---|---|
| 4,660,269 | | 4/1987 | Suzuki . | |
| 5,195,229 | * | 3/1993 | Hughes | 74/567 |
| 5,245,888 | * | 9/1993 | Tsuzuki et al. | 74/527 |
| 5,724,860 | * | 3/1998 | Sekiguchi et al. | 29/888.1 |
| 5,960,660 | * | 10/1999 | Klaas et al. | 29/888.1 |

FOREIGN PATENT DOCUMENTS

| | | |
|---|---|---|
| 0 733 154 | 9/1996 | (EP) . |
| 2 152 858 | 8/1985 | (GB) . |

OTHER PUBLICATIONS

Patent Abstracts of Japan, vol. 95, No. 8, Sep. 29, 1995.

* cited by examiner

*Primary Examiner*—I Cuda Rosenbaum
(74) *Attorney, Agent, or Firm*—Smith-Hill and Bedell

(57) ABSTRACT

A method is described for manufacturing a multi-component camshaft assembly having an internal mechanism for enabling relative angular movement of individual cams of the assembly. In the invention, the cam surfaces are machined after the individual components of the camshaft assembly have been assembled to one another.

8 Claims, 2 Drawing Sheets

METHOD OF MANUFACTURING A MULTI-COMPONENT CAMSHAFT

Figure 1:
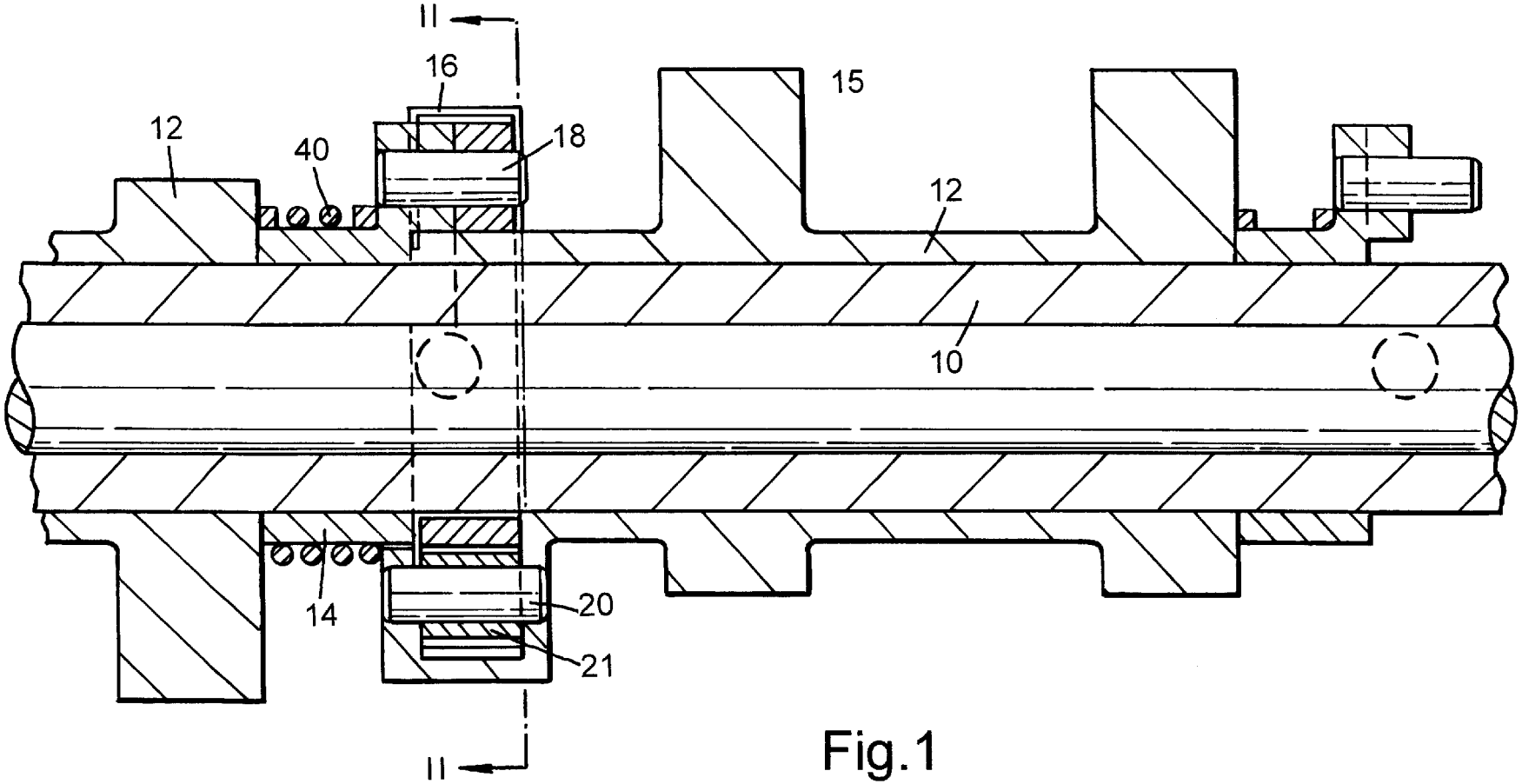

The present invention relates to the manufacture of a multi-component camshaft assembly.

Conventionally, camshafts of internal combustion engines are made as one-piece solid components in which the cams cannot move relative to one another nor relative to the bearings. With such camshafts, the phases of the valve events and their durations are fixed and cannot be varied with the engine operating conditions. As a result, engine performance can only be optimised for some operating conditions.

To allow the timing and/or duration of valve events to be adjusted during engine operation, it has been proposed to use a multi-component camshaft assembly in which the individual cams can be rotated about the axis of the shaft by a suitable actuating mechanism disposed within the shaft. One example of such a multi-component camshaft assembly is described in EP-A-0 733 154.

Such multi-component camshaft assemblies are costly to manufacture because of the precision required in the manufacture of the individual components in order to avoid excessive build-up of tolerances.

The present invention therefore seeks to provide a method of manufacturing multi-component camshaft assembly in which the foregoing disadvantage is mitigated.

According to the present invention, there is provided a method of manufacturing a multi-component camshaft assembly having an internal mechanism for enabling relative angular movement of individual cams of the assembly, in which method the cam surfaces are machined after the individual components of the camshaft assembly have been assembled to one another.

On account of the fact that, in the present invention, the cams are not accurately machined until after the components of the camshaft assembly have been assembled to one another, tolerance build up is avoided and the camshaft assembly can be machined in the same manner as would normally be employed to machine the cams and bearings of a one-piece camshaft.

In a preferred embodiment of the invention, after the camshaft components have been assembled to one another but prior to the machining of the surfaces of the camshaft assembly, the assembly is temporarily filled with a viscous or solid material that can be removed after the cam surfaces have been machined. Such filling of the spaces within the camshaft assembly during the machining of the cam surfaces serves the dual purpose of preventing the components from moving relative to one another and of avoiding ingress of debris, metal filings and swarf into the interior spaces of the camshaft assembly. Once machining has been completed, the filling material is removed from the interior of the camshaft assembly.

The filling material may be a grease that is pumped into the interior of the camshaft using a grease gun and subsequently removed by the application of heat or by flushing with a solvent. Alternatively, the material could be a wax or low melting point metal that can be introduced into the interior of the camshaft by means of a vacuum and removed by melting.

An alternative method of preventing the ingress of debris is to pressurise the interior spaces of the camshaft assembly during the machining of the cam surfaces. A lubricant can be pumped through the mechanism while it is being worked to prevent debris from penetrating into the interior spaces. In this case, the lubricant will not act to prevent the components from moving relative to one another but this function can be achieved separately, for example by providing a clamping bolt that is tightened during the machining and subsequently released when the camshaft is assembled to an engine.

Figure 2:
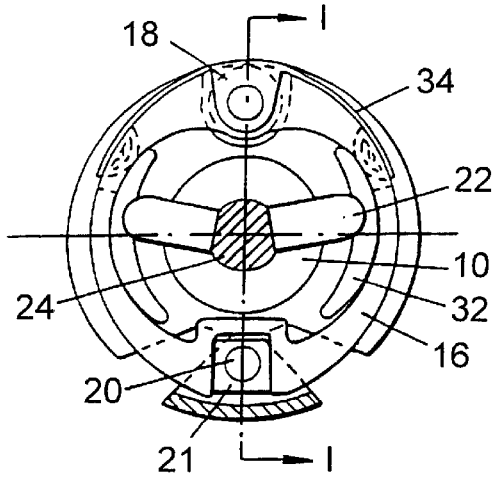
Figure 3:
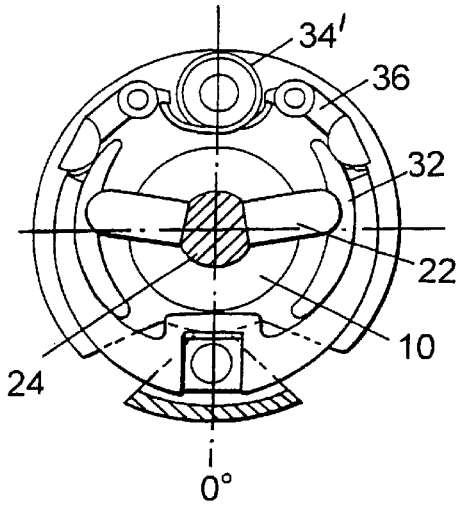
Figure 4:
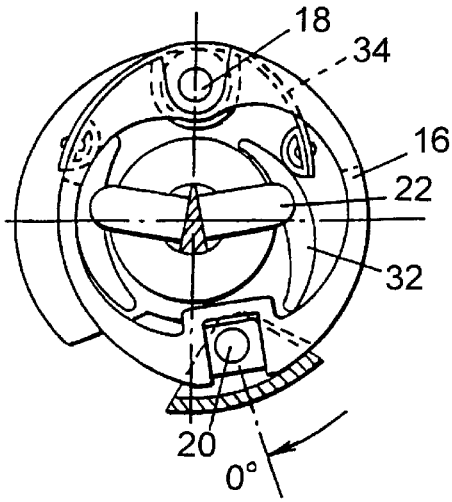
Figure 5:
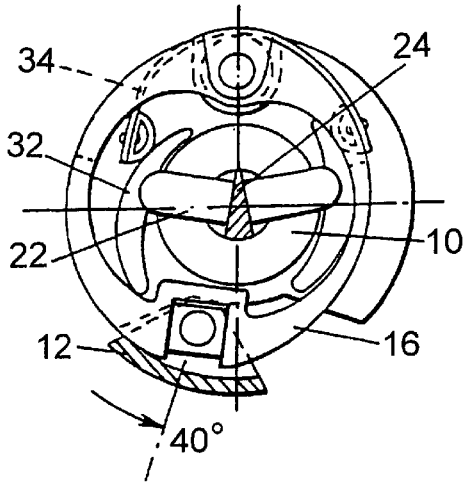
Figure 6:
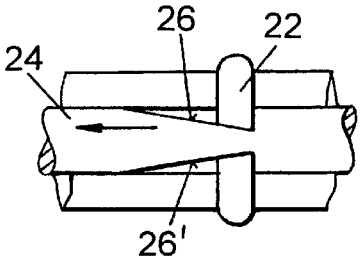
Figure 7:
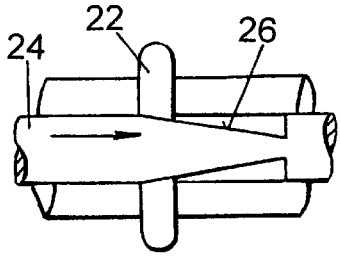

The invention will now be described further, by way of example, with reference to the accompanying drawings, in which:

FIG. 1 is a section through a camshaft along the section plane I—I in FIG. 2 for an engine with variable event timing, FIG. 2 is a section through the plane II—II in FIG. 1, passing through the axis of the camshaft, showing both plungers in their fully extended position, FIG. 3 is a section similar to that of FIG. 2, showing an alternative embodiment of the invention, FIGS. 4 and 5 show sections similar to that of FIG. 2 that demonstrate the manner in which variable event timing is achieved by moving the plungers, and FIGS. 6 and 7 show the movement of the plungers by the actuating rod in order to achieve the desired variation of the valve event in FIGS. 4 and 5.

In the drawings, a camshaft assembly is illustrated that comprises a hollow shaft 10 and a collar 14 fast in rotation with the hollow shaft 10. A sleeve 12 is journalled about the hollow shaft 10 and carries one or more cams 15. Coupling between the cam sleeve 12 and the collar 14 is established through a yoke 16 that surrounds the hollow shaft 10 and is connected by a pivot pin 18 to the collar 14. The yoke 16 is also coupled by pivot pin 20 and a sliding block 21 to the sleeve 12. The yoke 16 can move from side to side, i.e. radially, relative to the shaft 10 under the action of the reaction forces on the cams 15. The extent of such movement is limited by means of plungers 22 that pass through radial bores in the shaft 10 and rest on cam surfaces 26 (see FIGS. 6 and 7) of an actuating rod 24 that can slide axially within the hollow shaft 10. Axial movement of the rod 24, as seen from FIGS. 6 and 7, symmetrically moves the plungers 22 radially and these in turn act by way of arcuate shoes 32 on the inner surface of the yoke 16.

In use, when the engine is operating at high speed or high load the actuating rod 24 moves into the position shown in FIG. 7, which corresponds also to the position illustrated in FIG. 2. The plungers 22 are fully extended and provide a firm coupling with no lost motion between the collar 14 and the cam sleeve 12 so that the duration of the valve event is fixed.

Under idle and low load conditions, the actuating rod 24 is moved towards the position shown in FIG. 6 in which the plungers 22 are fully retracted. In this position of the plungers 22, depending upon the net torque acting on the cam sleeve 12, the yoke 16 may adopt either one of the positions shown in FIGS. 4 and 5. Initially, as the valve commences to open the yoke 16 it lies the position shown in FIG. 4 in which the cam is fully retarded to its reference phase, shown in the drawing as being 0°. Until the valve is fully open, the yoke 16 remains in this position but after passing the full lift position the yoke 16 commences movement towards the position shown in FIG. 5 in which it may be advanced as much as 40°.

The change-over from the position shown in FIG. 4 to that in FIG. 5 is caused by the force resulting from the reaction of the valve spring. The resultant torque causes the shoes 32 to rock about the ends of the plungers 22, while the biasing leaf spring 34 located about the pivot pin 18 ensures that contact is maintained at all times. There is therefore permanent contact between the shoes 32 and the inner surfaces of the yoke 16, the line of contact rolling as the yoke moves between its end positions. Such rolling of the point of contact results in more silent operation, and the noise suppression is further improved by the oil layer at the point of contact which is progressively swept to the centre. When the shoes are fully seated on the inner surface of the yoke 16, they act as positive stops preventing any further movement of the yoke. The purpose of the leaf spring 34 is to ensure that the shoes 32 always remain in contact with the inner surface of the yoke and the ends of the plungers 32.

After the valve has been fully seated it is necessary to return the yoke 16 to the position shown in FIG. 4 in readiness for the next operating cycle. This is effected by means of a coiled spring 40 fitted about the collar 14 that acts to bias the cam sleeve 12 towards its reference phase position.

The embodiment of FIG. 3 from the other described embodiment in the manner in which a spring force is applied to the shoes 32. In place of the leaf spring 34 acting directly on the ends of the shoes 32, the force of a coil spring 34' is relayed to the shoes 32 by a pair of rockers 36 mounted about fixed pivots. In this embodiment coil springs offer the advantage of being more fatigue resistant and reliable than leaf springs but there is a cost penalty in providing the additional rockers 36.

The camshaft assembly of FIG. 1 is assembled progressively by sliding the cam sleeves 12 and the collars 14 over the hollow shaft 10. The collars are keyed to the shaft by roll pins or Woodruff keys that do not interfere with the passage of the cam sleeves 12 over the hollow shaft 10. The plungers 22 are inserted radially through the holes in the hollow shaft 10 to make contact with the cams 26 of the actuating rod 24 that is initially inserted into the hollow shaft and thereafter the shoes 32 are placed over the ends of the plungers 22. The yoke 16 located on the sliding block 21 of the associated cam sleeve 12 is then slid as a complete sub-assembly to locate about the pin 18, at the same time retaining the shoes 32.

The above description and the drawings are of embodiments of a camshaft assembly that are already known from EP-A-0 733 154. This description is repeated to provide an example of a camshaft assembly to which the method of the invention may be applied, but it should be made clear that the invention is applicable to any camshaft assembly made up of relatively movable components to enable relative phase shifting of cams or to vary valve event duration.

Because each of the components of the described camshaft assembly has a manufacturing tolerance, after the camshaft has been assembled these tolerances stack up. To maintain the variations of the cam profiles within acceptable limits in the assembled camshaft, it is necessary to machine the individual components with significantly greater accuracy and this adds to the manufacturing cost.

To mitigate this problem, the present invention proposes manufacturing the camshaft components and assembling them before the cam surfaces are machined. The surfaces of the cams and the bearings are then machined on the assembled camshaft in the same manner as for a conventional one-piece camshaft. In this way, the desired tolerance of the components of the assembled camshaft can be achieved without resorting to reduced tolerances in the manufacture of the components.

To prevent movement between the camshaft components and avoid swarf and other debris from causing damage to the cam actuating mechanism within the shaft, the shaft is preferably filled with a material such as grease, wax or a low melting point metal prior to the machining. The shaft can be vacuum filled with melted wax or other low melting point material or grease can be injected into the shaft under pressure using a grease gun. The material in the shaft is removed by heat or a solvent after the machining of the working surfaces has been completed.

Alternatively, ingress of debris can be prevented by pressurising the interior spaces of the camshaft assembly during the machining of the cam surfaces. A lubricant can be pumped through the mechanism while it is being worked to prevent debris from penetrating into the interior spaces. It is conventional to coat surfaces with a coolant lubricant while they are being worked and the same lubricant may be injected under pressure into the camshaft, using a suitable rotary coupling. As the lubricant will not in this case act to prevent the components from moving relative to one another alternative steps need to be taken for this purpose, for example by providing a clamping bolt on the camshaft that is tightened during the machining and subsequently released when the camshaft is assembled to an engine. Such a clamping bolt may also be used when the camshaft is filled lo with grease or wax during the machining if the grease or wax alone does not suffice to lock the components of the mechanism firmly to one another.

What is claimed is:

1. A method of manufacturing a multi-component camshaft assembly having an internal mechanism for enabling relative angular movement of individual cams of the assembly, the method comprising the steps of assembling relatively movable components of the camshaft assembly to one another, locking the relatively movable components of the camshaft assembly to one another, machining cam surfaces while the assembled components of the camshaft assembly are locked relative to one another, and releasing the assembled components to enable them to move relative to one another after the cam surfaces have been machined.

2. A method as claimed in claim 1, wherein the step of locking the components comprises filling interior spaces of the camshaft assembly with a viscous or solid material, and the step of releasing the components includes removing the material from within the assembly.

3. A method as claimed in claim 2, wherein the material used to fill the interior spaces of the camshaft assembly comprises a wax or a low melting point metal.

4. A method as claimed in claim 3, comprising introducing the filling material into the camshaft assembly by vacuum filling and removing the filling material from the assembly by the application of heat.

5. A method as claimed in claim 2, wherein the material used to fill the interior spaces of the camshaft assembly is a grease and the method comprises introducing the grease under pressure into the interior spaces of the camshaft assembly and removing the grease from within the camshaft assembly with the aid of a solvent.

6. A method as claimed in claim 8, comprising pumping a fluid under pressure into interior spaces of the camshaft assembly during the machining of the surfaces in order to prevent ingress of debris into said interior spaces.

7. A method as claimed in claim 1, wherein the method comprises providing a clamping means in the camshaft assembly, the step of locking the components comprises tightening the clamping means prior to the machining of the surfaces of the camshaft to prevent the components of the camshaft assembly from moving relative to one another, and the step of releasing the components comprises releasing the clamping means.

8. A method as claimed in claim 2, wherein the method comprises providing a clamping means in the camshaft assembly and the step of locking the components additionally comprises tightening the clamping means prior to the machining of the surfaces of the cams to prevent the components of the camshaft assembly from moving relative to one another and the step of releasing the components comprises releasing the clamping means.

* * * * *